US006814709B2

(12) United States Patent
Schwartz et al.

(10) Patent No.: US 6,814,709 B2
(45) Date of Patent: Nov. 9, 2004

(54) MASSAGING BED REST CUSHION WITH LIGHT

(75) Inventors: Steven Schwartz, Nashua, NH (US); David Harris, Nashua, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 247 days.

(21) Appl. No.: 09/801,353

(22) Filed: Mar. 7, 2001

(65) Prior Publication Data

US 2001/0052153 A1 Dec. 20, 2001

Related U.S. Application Data

(60) Provisional application No. 60/212,433, filed on Jun. 16, 2000.

(51) Int. Cl.[7] ..... A61H 1/00; A47B 97/00

(52) U.S. Cl. ..... 601/57; 601/58; 601/49; 5/633

(58) Field of Search ..... 601/46, 89, 90, 601/91, 92, 93, 98–104, 49, 56, 57, 58, 59; 5/633, 904, 905, 915; 297/149, 217.3, 217.6

(56) References Cited

U.S. PATENT DOCUMENTS

| | | | | | |
|---|---|---|---|---|---|
| 3,654,454 | A | * | 4/1972 | Olesen | 362/19 |
| 3,736,920 | A | * | 6/1973 | Mathers et al. | 601/116 |
| 3,879,086 | A | * | 4/1975 | Moceri | 135/16 |
| 4,022,195 | A | * | 5/1977 | Meyer et al. | 601/18 |
| 4,233,649 | A | | 11/1980 | Scheer et al. | |
| 4,686,967 | A | | 8/1987 | Hashimoto et al. | |
| 4,868,888 | A | * | 9/1989 | Dayton | 297/217.4 |
| 5,020,517 | A | | 6/1991 | Foster, Jr. et al. | |
| 5,033,458 | A | | 7/1991 | Sperr | |
| 5,184,607 | A | | 2/1993 | Hwang | |
| 5,188,096 | A | | 2/1993 | Yoo | |
| 5,316,369 | A | * | 5/1994 | Kanda | 297/135 |
| 5,335,962 | A | * | 8/1994 | Gera | 297/135 |
| 5,429,585 | A | * | 7/1995 | Liang | 600/9 |
| 5,453,586 | A | * | 9/1995 | Stottmann | 200/302.2 |
| 5,460,598 | A | | 10/1995 | Yamasaki et al. | |
| 5,462,515 | A | | 10/1995 | Tseng | |
| 5,503,457 | A | * | 4/1996 | Rosado | 297/448.1 |
| 5,613,222 | A | * | 3/1997 | Guenther | 379/430 |
| 5,696,574 | A | * | 12/1997 | Schwaegerle | 351/245 |
| 5,713,832 | A | | 2/1998 | Jain | |
| 5,827,206 | A | | 10/1998 | Lunter | |
| 5,836,645 | A | | 11/1998 | Sakaue et al. | |
| 5,836,900 | A | | 11/1998 | Leventhal | |
| 5,838,808 | A | * | 11/1998 | Prosser | 381/388 |
| 5,868,687 | A | | 2/1999 | Tedesco | |
| 5,895,365 | A | | 4/1999 | Tomlinson | |
| 6,077,238 | A | | 6/2000 | Chung | |
| 6,102,476 | A | * | 8/2000 | May et al. | 297/188.19 |
| 6,126,233 | A | | 10/2000 | Gaetano et al. | |
| 6,154,690 | A | * | 11/2000 | Coleman | 180/65.1 |
| 6,388,345 | B1 | * | 5/2002 | Stimpson | 174/66 |

* cited by examiner

*Primary Examiner*—Nicholas D. Lucchesi
*Assistant Examiner*—Quang D Thanh
(74) *Attorney, Agent, or Firm*—Hayes Soloway, P.C.

(57) ABSTRACT

A cushion/backrest including an integrated reading lamp tethered at the end of a flexible member is disclosed for providing the user with a source of light for reading or watching television. The cushion may also include built in massage motors for providing the user with a massaging action to the back. Controls for adjusting the massaging action and the reading lamp may be incorporated in an armrest.

48 Claims, 6 Drawing Sheets

MASSAGING BED REST CUSHION WITH LIGHT

CROSS-REFERENCE TO RELATED APPLICATIONS

This application claims the benefit of copending U.S. provisional patent application Ser. No. 60/212,433 filed Jun. 16, 2000, the teachings of which are incorporated herein by reference.

FIELD OF THE INVENTION

The present invention relates to a back cushion, and more particularly, to a back cushion or bed lounger including built in massage motors for providing the user with a massaging action to the back, an integrated reading lamp, and controls for the massaging action and the reading lamp.

BACKGROUND OF THE INVENTION

Cushioned bed loungers are known in the art. Bed loungers normally include a back portion and armrests or elbow rests. The back portion may be contoured and may include a padded neck or headrest. Chair back massagers also are known in the art. One form of prior art back massager is in the form of a pad containing a mechanical massage arrangement powered by electricity. In use, a person places the massager against the back of a chair, automobile seat, or couch and then sits downs and leans back against the massaging device. Other configurations have the massaging elements built into the seat back, for example in a lounge chair or automobile seat. Such massagers include a back portion including a massaging element driven by an electric motor.

Tomlinson, U.S. Pat. No. 5,895,365 discloses a bed rest cushion for providing a vibrating massage including a back portion, having a contoured forward surface and a planar rear surface. The back portion includes a padded interior and a plurality of vibrating transducers disposed within the padded interior. The transducers have an electrical cord extending therefrom for coupling with an electric outlet. Armrests are pivotally coupled to the back portion and a control panel having multiple settings is in electrical communication with the vibrating transducers. A collapsible rectangular tray including L-shaped brackets may be secured to holes in one of the armrests and a light may be attached to the collapsible tray. The light has an electric cord for coupling with an electrical outlet on the control panel. Though no description of the contours of the cushion is given, there is nothing to indicate a lower back support which properly angles the user's shoulders against the back portion or that a head or neck rest is provided, so that the user will be comfortable, e.g., while reading or watching television. The separate light fixture and separate electric cord to be plugged into the control panel is a clumsy and cumbersome configuration which cannot be used unless attached to the tray, and is poorly positioned for providing a suitable reading light.

SUMMARY OF THE INVENTION

The present invention provides a cushion with an anatomically positioned and contoured head rest, shoulder and lower back support, and built-in massage motors in the back support to provide massage action. The cushion includes an integrated over the shoulder reading lamp extending from the back of the cushion and a control panel including a power on-off switch and power setting switches for the massager, and a power on/off switch or rheostat or solid state light dimmer for the integrated lamp. The lamp may include a light source, including but not limited to an incandescent, fluorescent, neon, or light emitting diodes (LED) light source.

In an alternative embodiment, massage motors may be provided within a movable cushion which is detachably connected to the back portion by means, e.g., of an hook-and-loop type strip located on a tab extending from the moveable cushion and a retractable electric cord connection on the rear side of the moveable cushion plugs into the back portion of the cushion. In such embodiment, the moveable cushion contains massaging elements comprising a plurality of pulsating transducers arranged within the moveable cushion.

Independent touch sensitive button controls for setting the speed of the motor, the levels of the vibration of the massaging elements and for power, and for turning the light off and on and a rheostat control may be maintained beneath a thin flexible membrane mounted on upper or side surfaces of an armrest. Alternatively independent touch sensitive controls may be a touch switch control panel, mounted on the upper or side surface of an armrest. The thin membrane that covers the individual buttons prevents introduction of powders, fluids, oils or the like, into the switches while allowing independent setting of the controls. Other control button configurations are contemplated including individual molded buttons. Alternatively, the control panel may be connected to the cushion through a cord. In such case, the cushion may include a pocket for stowing the control panel, or the control panel may be releasably mounted to the cushion by hook-and-loop fasteners of the like.

In another alternative embodiment a cushion for supporting a person in a sitting position may be provided. The cushion having a back portion having a contoured forward surface and a generally planar rear surface separated by a padded interior and a light source for providing light for a user, the light source being mounted to the back portion by an arm.

In yet another alternative embodiment a massaging bed cushion for supporting a person in a sitting position may be provided. The bed cushion having a back portion comprising a contoured forward surface and a generally planar rear surface separated by a padded interior, a plurality of massage motors enclosed between the forward surface and the rear surface, and a light source mounted to the back portion for providing light for a user.

BRIEF DESCRIPTION OF THE DRAWINGS

These and other objects, features and advantages of the present invention will be better understood with reference to the detailed description of the preferred embodiment and the accompanying drawings, wherein like numerals depict like parts, and wherein.

BRIEF DESCRIPTION OF THE PREFERRED EMBODIMENTS

Figure 1:
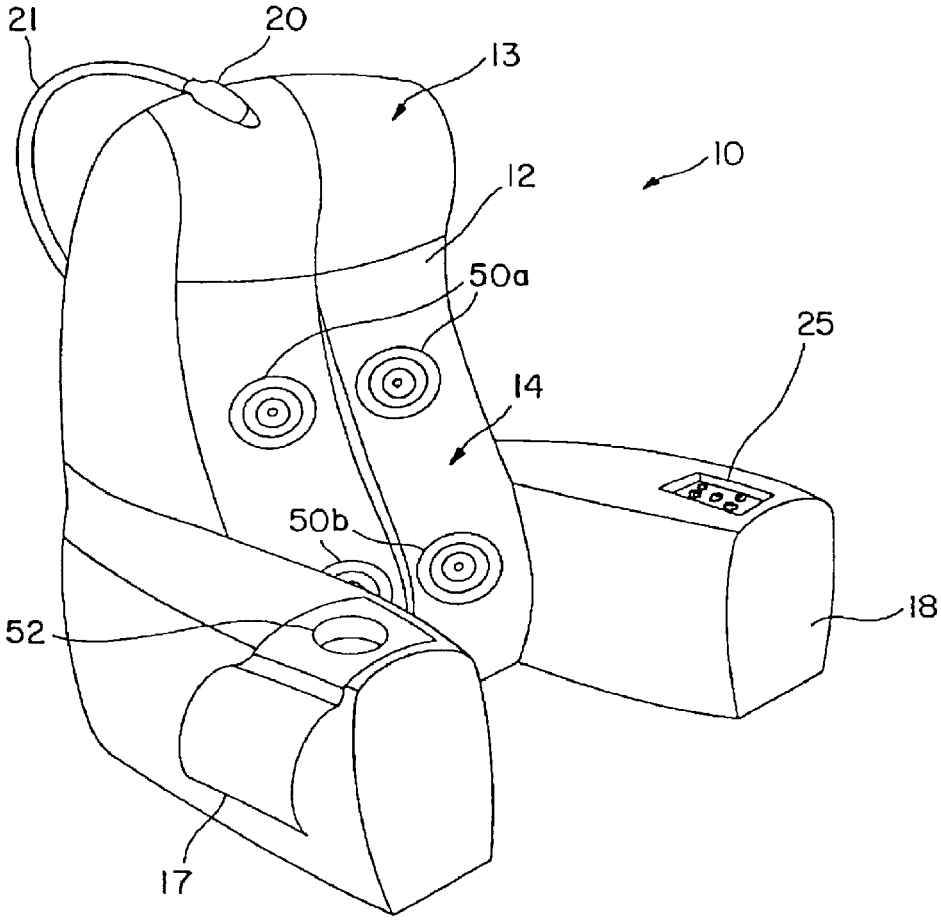
FIG. 1 is a perspective view of a cushion in accordance with one embodiment of the present invention.
Figure 2:
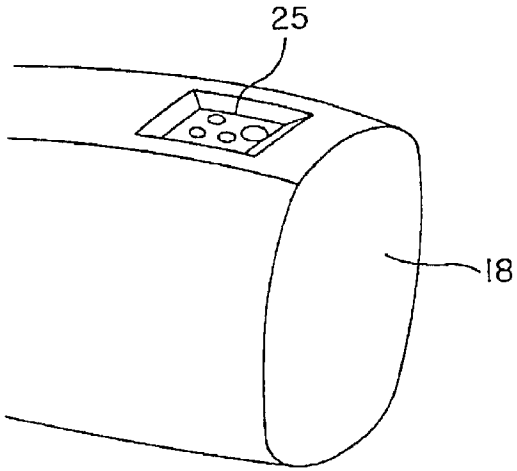
FIG. 2 is an enlarged view showing details of the armrest control of the FIG. 1 embodiment.

Referring to FIGS. 1 and 2, a cushion 10 comprises a padded back portion 12 including padded head rest portion 13 and padded lower back support portion 14 contoured so as to be anatomically comfortable for the user. The back portion may comprise a contoured forward surface and a generally planar rear surface, the surfaces separated by a padded interior. Two pairs of massage motors 50*b,* 50*a* may be built into the cushion 10 in the area of the lower back and mid back area respectively, for massaging, respectively the lower back and scapula areas of the user. Massage motors 50*a,* 50*b* may comprise vibratory or percussive massage motors or pulsating transducers or powered rollers arranged within the back portion 12 to provide a massage. Power to the cushion 10 may be provided by electricity through AC cord and plug connection or by a rechargeable battery housed within the cushion and chargeable through a connection on the cushion (not shown).

Figure 3:
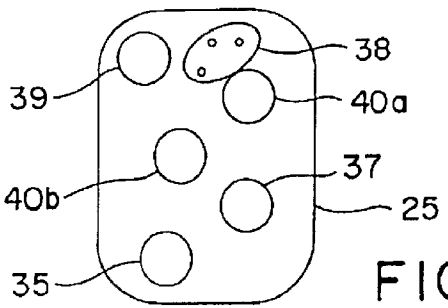
FIGS. 3 and 4 are plan views of alternative embodiments of control panels of the FIG. 1 embodiment.
Figure 4:
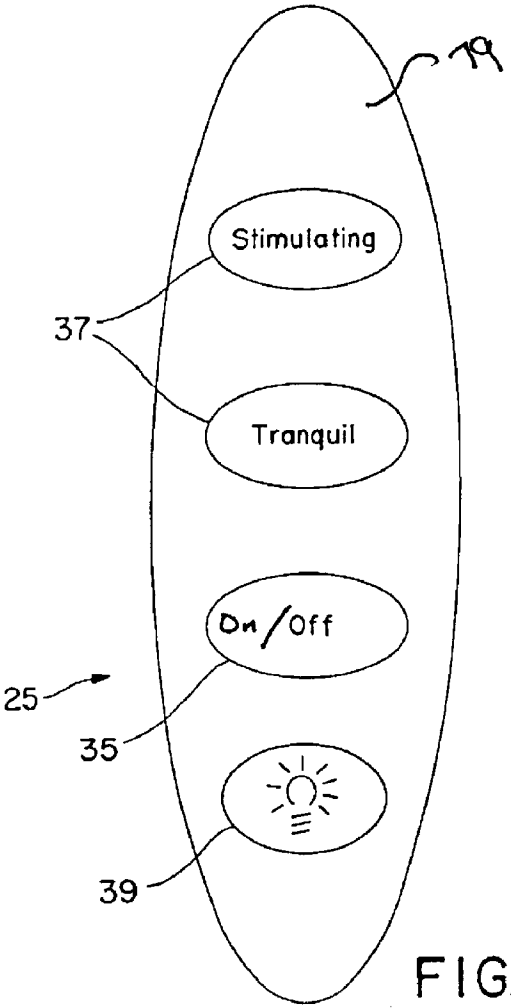

Padded armrests 17 and 18 may extend outwardly from opposite corners at the bottom of the back portion 12 substantially perpendicular to the rear surface. Armrest 18 may include a control panel 25. As shown in FIG. 3, the control panel 25 may be covered with a thin flexible membrane 79 covering a plurality of touch sensitive control buttons/actuators or switches, including power on/off button 35, power on indicator light 36, speed setting control button or buttons (FIG. 4) 37, LED speed indicators 38, light on/off switch 39 for altering the on/off status of the lamp 20, and massage program buttons 40*a, b* for adjusting the pulsating transducers or massage motors located in the bed lounger back and for setting massage sensation and intensity of the massaging elements. The thin tactile membrane covering the full control panel may help keep massage oils, powder, fluids, or the like from gumming up the buttons or otherwise entering the cushion itself. This can make cleaning easier and provide longer operational life.

An over-the-shoulder lamp 20 may extend from the rear of the back portion 12 of the cushion 10 on a flexible arm 21. Alternatively, the lamp 20 may extend from the front surface or a side surface of the cushion. Lamp 20 and arm 21 may be pivotably connectable at the rear of the cushion 10 to a lamp support housing (not shown) through which an electrical communication may be made and the lamp 20 can be turned off or on. The flexible arm 21 may enable the user to adjust the angel and position of lamp 20. The mass and materials forming the cushion may provide sufficient vibration attenuation and isolation to protect the filaments of a light bulb in the reading lamp.

Preferably, an insulated drink holder 52 may be located in armrest 17. If desired, a removable cover (not shown) may be provided for closing off drink holder 52, when not in use.

Referring to FIGS. 5–9, there is shown an alternative embodiment of a cushion in accordance with the present invention.

Referring to FIGS. 5–9, a cushion 110 comprises a padded back portion 112 including padded head rest portion 113 and padded lower back support portion 114 contoured so as to be anatomically comfortable for the user. The back portion may comprise a contoured forward surface and a generally planar rear surface 180, the surfaces separated by a padded interior. Alternatively, the contoured front surface and the planar rear surface maybe separated by an inflatable bladder. The firmness of the bladder may be user adjustable. The bladder may be filled by a pump located inside or outside of the bed cushion. A movable massage cushion 115 may be attached to the cushion 110 in the area of the lower back support portion 114 by means of a hook-and-loop fastener system wherein, e.g. a hook-type strip 223 arranged on tab 116 extending from the movable massaging cushion 115. Hook type strip engages with loops on the fabric of the back, or with loop strips mounted on the back. Pulsating transducers or massage motors arranged within the massaging cushion 115 may provide a massage. At the option of the user, by disengaging hook-strip 223, massage cushion 115 may be moved to therapeutically deliver massage to other areas of the body, the back or neck, for example, or may be used simply as a pillow. If desired, massage cushion 115 may be unplugged from and detached entirely from the cushion 110. Power to the cushion 110 may be provided by electricity through AC cord and plug connection 130 and 131 respectively or by a rechargeable battery 181 housed within the cushion 110 and chargeable through a connection on the cushion (not shown). Power to the massaging cushion 115 may be provided by extendable power cord 221 and plug 222 which can be connected to an outlet (not shown) located on the cushion 110, for example on the back portion 112 or on an armrest 117 or 118.

Figure 5:
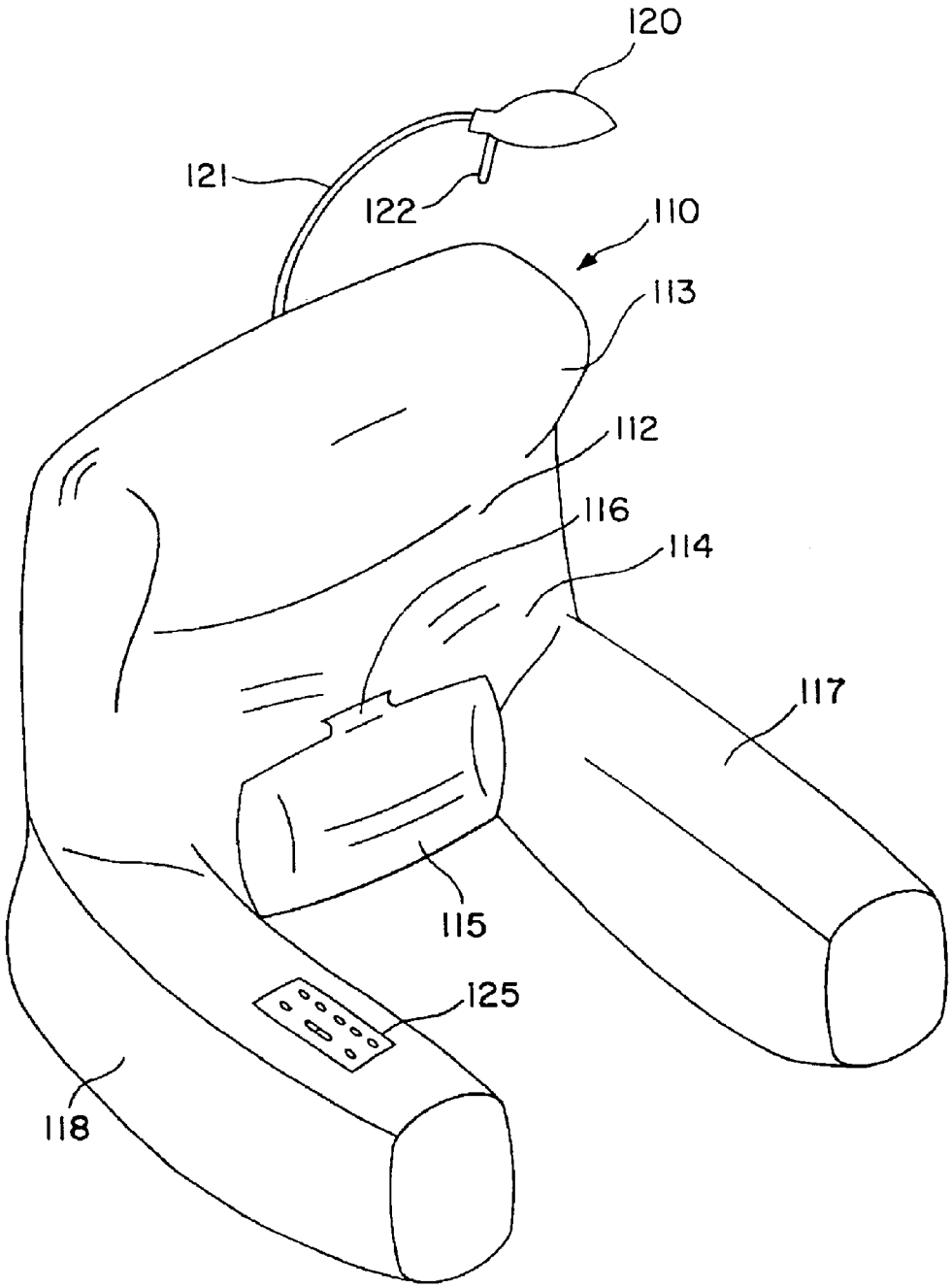
FIG. 5 is a perspective view of an alternative form of cushion in accordance with the present invention.

Padded armrests 117 and 118 may extend outwardly from opposite comers at the bottom of the back portion 112 substantially perpendicular to the rear surface. Armrest 118 may include a control panel 125. As shown in FIG. 5, the control panel 125 may be covered with a thin flexible membrane covering a plurality of touch sensitive control buttons/actuators or switches, including power on/off button 135, power on indicator light 136, speed setting control button 137, LED speed indicator 138, light on/off toggle switch 139, and various massage program buttons 140*a–d* for adjusting the pulsating transducers or massage motors located in the massage cushion 115 and for setting massage sensation and intensity of the massaging elements. The thin tactile membrane covering the full control panel 125 may help keep massage oils, powder, fluids, or the like from gumming up the buttons or otherwise entering the cushion itself. This can make cleaning easier and provide longer operational life.

Alternatively, as shown in phantom, the control may comprise hand-held device 300 connected via wire 302 and stowable in a pocket 304 in the arm or removably attachable to the arm via hook-and-loop fasteners (not shown).

An over-the-shoulder lamp 120 may extend from the rear of the back portion 112 of the cushion 110 on an arm 121. Alternatively, the lamp 120 may extend from the front surface or a side surface of the cushion. Lamp 120 and arm 121 may be pivotably connectable at the rear of the cushion 110 to lamp support housing 123. Lamp support housing 123 also may be removably attachable to the cushion 110. By securing lamp support housing 123 to the cushion 110, an electrical communication may be made and the status of the lamp 120 can adjusted or altered using switch 139. The electrical communication between the lamp 120 and the control panel 125 may be enclosed within the interior of the cushion 110. The switch 139 located on control panel 125 may operate as a toggle switch to alter the on/off status of the light source in the lamp 120 and/or as a light dimmer to adjust the intensity of the light source in the lamp 120. The light dimmer can be a rheostat or a solid state dimmer. The user can alter the on/off status of the light source using the toggle switch and can adjust the intensity of the light source using the rheostat or the solid state dimmer. Handle 122 may enable the user to adjust the angle and position of lamp 120. The mass and materials forming the cushion may provide sufficient vibration attenuation and isolation to protect the filaments of a light bulb in the reading lamp.

Figure 6:
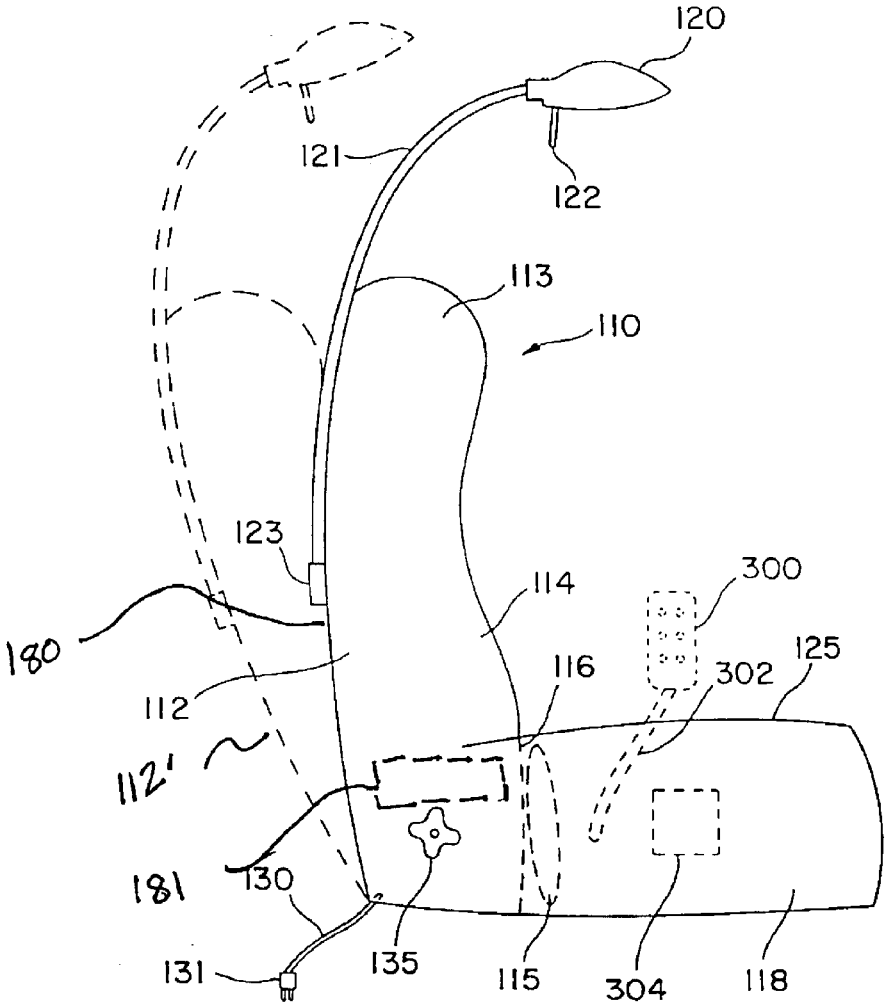
FIG. 6 is a side plan view of the cushion shown in FIG. 5.
Figure 7:
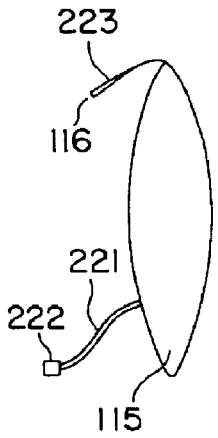
FIG. 7 is a side view of the massage cushion in accordance with the FIG. 5 embodiment.
Figure 8:
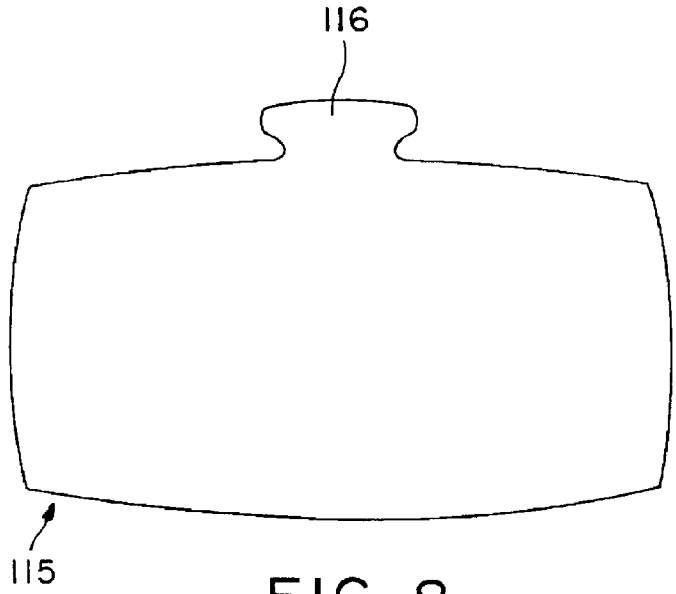
FIG. 8 is a front of the massage cushion shown in FIG. 7.
Figure 9:
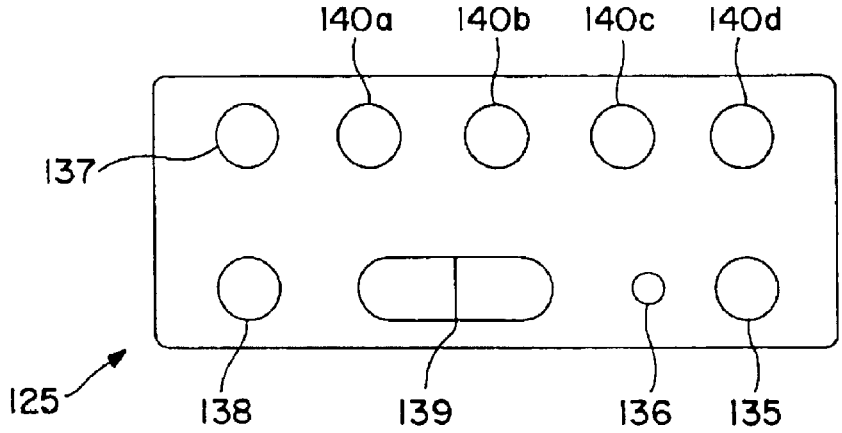
FIG. 9 is a top plan view of the control panel according to the FIG. 5 embodiment.

As shown in FIG. 6, the back portion 112 of the cushion 110 is capable of being reclined. The back portion 112 can be adjusted to a variety of angles relative to the armrests 117 and 118. The back portion and the armrest can be locked in a desired position with a knob 135. The armrests 117 and 118 may be foldable into an upright position along side the back portion 112. Alternatively, the armrest may be removable attached to the back portion with a hook and loop type fasteners. To adjust the angle, the user simply detaches the armrests and then reattaches them to the back portion at a different angle, shown by adjusted back portion 112.

Through positioning of the massaging cushion 115 the massager may be capable of adjusting to and making contact with the contours of the body thereby providing maximum therapeutic massage effect to various body parts previously unreached by conventional massage bed rests. This may provide the user with a greater range of therapy and will accordingly be of greater benefit. In addition, with the ability to independently manipulate the speed, intensity and the pattern of the massage, the user may create a multitude of sensations to attain the desired result.

Figure 10:
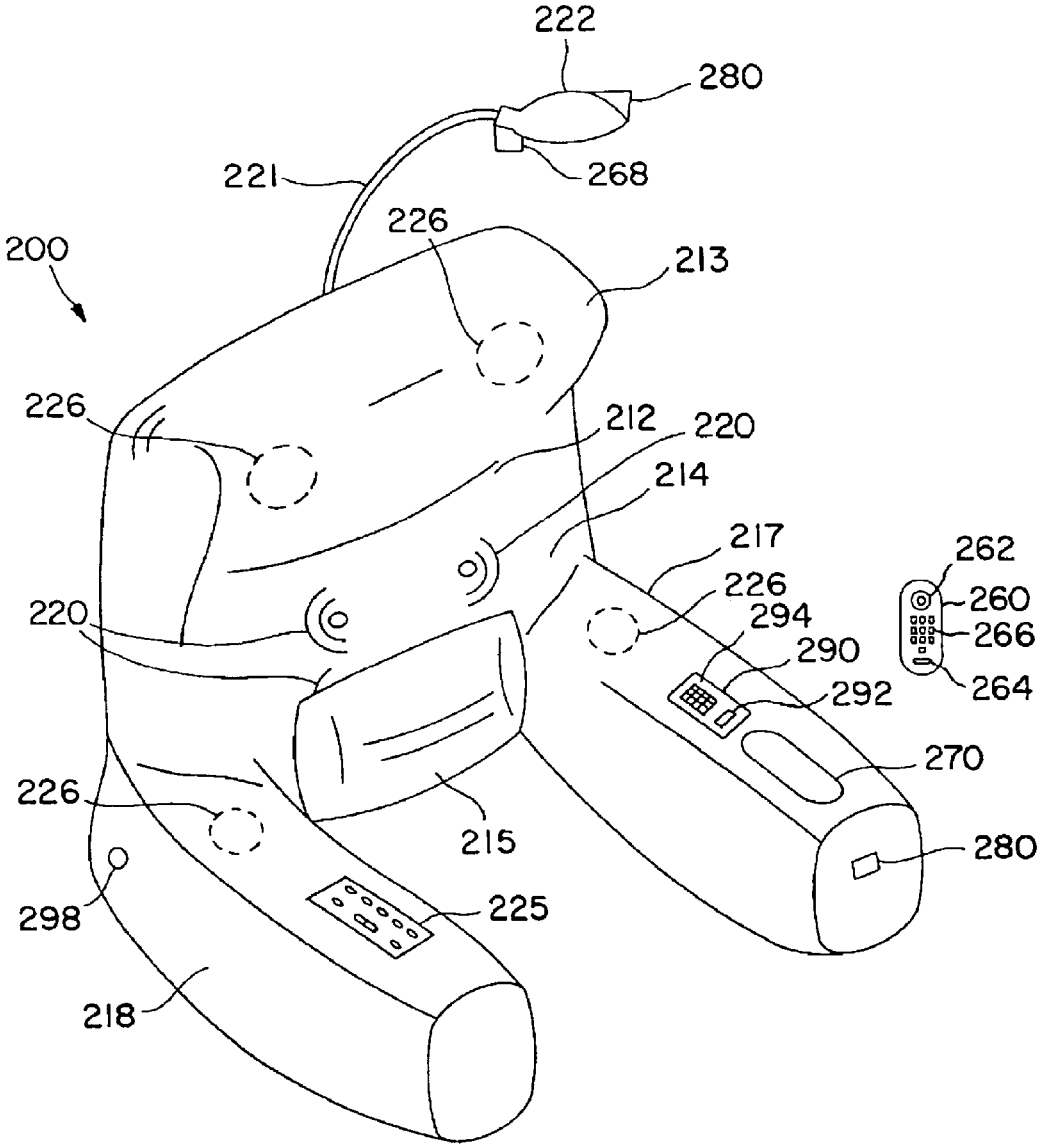
FIG. 10 is a perspective view of a cushion in accordance with another embodiment of the present invention.

Referring to FIG. 10, a cushion 200 comprises a back portion 212 including padded head rest portion 213 and padded lower back support portion 214 contoured so as to be anatomically comfortable for the user. The back portion 212 may comprise a contoured forward surface and a generally planar rear surface. The bed cushion may further comprise armrests 217 and 218.

A heat source 220 may be built into the cushion 200 in the area of the lower back and/or mid back area, for providing heat to a user. Controls may be provided in a control panel 225 to allow the user to adjust the heat output.

A movable pad 215 may be attached to the bed rest cushion 200 in the area of the lower back and/or mid back area by means of a hook-and-loop fastener system. The pad 215 may comprise a liquid-absorbable material such as a sponge or foam material. When moistened, the pad 215 and the heat source 220 can provide the user with a moist source of heat. The absorbable material may be enclosed in a washable cover material.

The bed rest cushion 200 may comprise a speaker or a plurality of speaker 226 located in the head-rest portion 213 and/or in the armrests 217 and 218. The speaker/s may be capable of generating sound waves such as soothing sounds or music from an audio source located within the bed cushion or from an external audio source.

The bed cushion 200 may further comprise a telephone. The telephone may have a corded or cordless handset 260 with buttons 266 for accepting or making phone calls, a speaker 262 and a microphone 264. The bed cushion may have a cradle 270 to hold the handset 260 and/or recharge the phone. The base station for the cordless handset may be housed within the bed cushion or located outside the bed cushion.

In another embodiment, there is no handset. The speaker/s 226 may be utilized to allow the user to listen to a call and a microphone 268, possibly housed at the end of a flexible arm 221, may be utilized to allow the user to talk during a call. The flexible arm 221 may also house a lamp 222. In this embodiment, a control panel 290 may comprise a button 292 for initiating and/or ending a phone call and buttons 294 for dialing phone numbers. The control panel 290 may further comprise user programmable or factory preprogrammed speed dial buttons that allow the user to quickly connect with the police and/or frequently called family and friends.

The bed cushion 200 may further comprise a built in remote control transmitter 280. Output signals such as infrared and radio frequency signals may be generated by actuation of buttons on the control panel 290 and may be sent to the device to be controlled through the transmitter 280 located in the armrest 217 or 218 or on the flexible arm 221.

The bed rest cushion may be enclosed in a washable removeable cover. The cover may also be splash resistant. The interior portion of the back portion and/or the arm rests of the bed cushion may comprise a single or multiple inflatable bladders or a medium or high-density foam. The inflatable bladder may be filled by an external pump through inlet 298 or by an internal pump controlled through the control panel 290. The cushion 10 and 110 may be embodied in many different varieties, including any combination of massagers, control panels, cup holders, heat sources, telephones, speakers, signal transmitters, and lamps.

Those skilled in the art will appreciate that still other modifications and variations of the present invention are possible in light of the above teaching. It is, therefore, to be understood that within the scope of the appended claims, the invention may be practiced otherwise than literally described, but fall within the scope therein

What is claimed is:

1. A bed cushion for supporting a person in a sitting position on an upper surface of a bed, comprising:

a back portion comprising a contoured forward surface and a generally planar rear surface, the surfaces separated by a padded interior;

at least one massage motor carried by the back portion;

a pair of padded armrests coupled to the back portion;

a light source for providing light for a user, the light source mounted to the back portion by an arm, wherein the back portion and the armrests have lower surfaces for resting on the upper surface of the bed; and a speaker for generating sound waves, the speaker integral with the cushion.

2. The bed cushion of claim 1, wherein the arm is flexible.

3. The bed cushion of claim 2, further comprising a handle coupled to the flexible arm to allow a user to adjust the position of the light source.

4. The bed cushion of claim 1, wherein the cushion has a mass located between the massage motor and a location on the back portion where the light source is mounted and is formed of materials which provide vibration attenuation and isolation to protect filaments in the light source.

5. The bed cushion of claim 1, further comprising a control panel for altering the on/off status of the light source.

6. The bed cushion of claim 5, wherein the control panel comprises at least one switch for altering the on/off status of the light source, the switch being covered by a flexible membrane.

7. The bed cushion of claim 5, wherein the light source is coupled to the control panel by an electrical communication, the electrical communication enclosed within the interior of the cushion.

8. The bed cushion of claim 1, wherein an armrest comprises an actuator for adjusting the intensity of the light source.

9. The bed cushion of claim 1, wherein an armrest comprises a cup holder.

10. The bed cushion of claim 1, further comprising a plurality of massage motors carried by the back portion.

11. The bed cushion of claim 10, further comprising a controller for altering the on/off status of the massage motors.

12. The bed cushion of claim 10, wherein the massage motors are enclosed between the forward surface and the rear surface.

13. The bed cushion of claim 10, wherein the massage motors are carried in a pillow which is removably detachable to the back portion.

14. The bed cushion of claim 10, wherein the massage motors comprise pulsating transducers.

15. The bed cushion of claim 10, wherein the massage motors comprise vibrating massage motors.

16. The bed cushion of claim 10, wherein the massage motors comprise percussive or roller massage motors.

17. The bed cushion of claim 1, further comprising a removable lamp support housing for coupling the arm to the back portion.

18. The bed cushion of claim 1, further comprising a battery for supplying power to the light source.

19. The bed cushion of claim 1, wherein the back portion is reclineably adjustable relative to the armrests.

20. The bed cushion of claim 1, further comprising a telephone base station integral with the cushion.

21. The bed cushion of claim 1, wherein the speaker is electrically coupled to a telephone base station enclosed within the cushion.

22. The bed cushion of claim 1, wherein the padded interior comprises an inflatable bladder.

23. The bed cushion of claim 1, further comprising a heat source enclosed within the cushion.

24. The bed cushion of claim 1, further comprising a transmitter for generating output signals, the transmitter coupled to the arm.

25. The cushion of claim 1, and comprising a hand-held control panel connected via a wire.

26. A bed cushion for supporting a person in a sitting position on an upper surface of a bed, comprising:

a back portion comprising a contoured forward surface and a generally planar rear surface, the surfaces separated by a padded interior;

a plurality of massage motors enclosed between the forward surface and the rear surface;

a pair of padded armrests coupled to the back portion;

a light source mounted to the back portion for providing light for a user, wherein the back portion and the armrests have lower surfaces for resting on the upper surface of the bed; and a speaker for generating sound waves, the speaker integral with the cushion.

27. The massaging bed rest cushion of claim 26, wherein the massage motors comprise vibratory massage motors.

28. The massaging bed rest cushion of claim 26, wherein the massage motors comprise percussive or roller massage motors.

29. The massaging bed rest cushion of claim 26, wherein the massage motors comprise pulsating transducers.

30. The massaging bed rest cushion of claim 26, wherein the light source is mounted to the back portion by a flexible arm.

31. The massaging bed rest cushion of claim 30, further comprising a removable lamp support for mounting the arm to the back portion.

32. The cushion of claim 30, further comprising a transmitter for generating output signals, the transmitter coupled to the flexible arm.

33. The massaging bed rest cushion of claim 26, wherein the cushion has a mass located between the massage motor and a location on the back portion where the light source is mounted and is formed of materials which provide vibration attenuation and isolation to protect filaments in the light source.

34. The cushion of claim 33, wherein the back portion is reclineably adjustable relative to the armrests.

35. The massaging bed rest cushion of claim 26, wherein an armrest comprises a cup holder.

36. The massaging bed rest cushion of claim 26, further comprising a control panel for altering the on/off status of the light source.

37. The massaging bed rest cushion of claim 36, wherein the control panel comprises at least one switch for altering the on/off status of the light, the switch being covered by a flexible membrane.

38. The massaging bed rest cushion of claim 36, wherein the light source is coupled to the control panel by an electrical connector, the electrical connector enclosed within the interior of the bed cushion.

39. The massaging bed rest cushion of claim 26, further comprising a control panel for altering the on/off status of the massage motors.

40. The massaging bed rest cushion of claim 26, further comprising an actuator for adjusting the intensity of the light source.

41. The cushion of claim 26, further comprising a telephone base station integral with the cushion.

42. The cushion of claim 27, wherein the speaker is electrically coupled to a telephone base station enclosed within the cushion.

43. The cushion of claim 26, wherein the padded interior comprises an inflatable bladder.

44. The cushion of claim 26, further comprising a heat source enclosed within the cushion.

45. The cushion of claim 26, and comprising a hand-held control panel connected via a wire.

46. A massaging bed rest cushion for supporting a person in a sitting position on an upper surface of a bed, comprising:

a back portion comprising a contoured forward surface and a rear surface, the surfaces separated by a padded interior, a plurality of massage motors enclosed between the forward surface and the rear surface;

a light source mounted to the back portion for providing light for a user;

a pair of padded armrests coupled to the back portion;

a heater enclosed within the cushion, wherein the back portion and the armrests have lower surfaces for resting on the upper surface of the bed; and a speaker for generating sound waves, the speaker integral with the cushion.

47. A massaging bed rest cushion for supporting a person in a sitting position on an upper surface of a bed, comprising:

a back portion comprising a contoured forward surface and a rear surface, the surfaces separated by a padded interior, a plurality of massage motors enclosed between the forward surface and the rear surface;

a light source mounted to the back portion for providing light for a user;

a heater enclosed within the cushion;

a pair of padded armrests coupled to the back portion;

a controller for altering the on/off status of the massage motors, wherein the back portion and the armrests have lower surfaces for resting on the upper surface of the bed; and a speaker for generating sound waves, the speaker integral with the cushion.

48. A massaging bed rest cushion for supporting a person in a sitting position on an upper surface of a bed, comprising:

a back portion comprising a contoured forward surface and a rear surface, the surfaces separated by a padded interior, a plurality of massage motors enclosed between the forward surface and the rear surface;

a light source mounted to the back portion for providing light for a user;

a controller for altering the on/off status of the massage motors;

a pair of padded armrests coupled to the back portion; and an on/off device on the controller for altering the on/off status of the light source, wherein the back portion and the armrests have lower surfaces for resting on the upper surface of the bed; and a speaker for generating sound waves, the speaker integral with the cushion.

* * * * *